US009096963B2

(12) United States Patent
Guerreschi

(10) Patent No.: US 9,096,963 B2
(45) Date of Patent: Aug. 4, 2015

(54) POSITIONING DEVICE FOR THE POSITIONING OF LOOPS FOR SEWING SAID LOOPS AND SEWING MACHINE COMPRISING SAID DEVICE

(71) Applicant: VI.BE.MAC. S.P.A., San Giovanni Lupatoto, Verona (IT)

(72) Inventor: Carlo Guerreschi, Verona (IT)

(73) Assignee: Vi.Be.Mac. S.p.A., San Giovanni Lupatoto, Verona (IT)

( * ) Notice: Subject to any disclaimer, the term of this patent is extended or adjusted under 35 U.S.C. 154(b) by 0 days.

(21) Appl. No.: 14/095,175

(22) Filed: Dec. 3, 2013

(65) Prior Publication Data

US 2014/0158034 A1 Jun. 12, 2014

(30) Foreign Application Priority Data

Dec. 7, 2012 (IT) ..... VR2012A0241

(51) Int. Cl.
*D05B 35/06* (2006.01)
*D05B 3/12* (2006.01)

(52) U.S. Cl.
CPC ..... *D05B 35/068* (2013.01); *D05B 3/12* (2013.01); *D05D 2303/20* (2013.01); *D05D 2305/02* (2013.01)

(58) Field of Classification Search
USPC ..... 112/2.1, 470.33, 470.34, 136, 147, 148, 112/152, 153, 306, 311, 314, 104
See application file for complete search history.

(56) References Cited

U.S. PATENT DOCUMENTS

| | | | | | |
|---|---|---|---|---|---|
| 4,389,957 | A * | 6/1983 | Block et al. | ..... | 112/475.06 |
| 4,561,366 | A * | 12/1985 | Schmidt et al. | ..... | 112/470.34 |
| 5,513,590 | A * | 5/1996 | Allison et al. | ..... | 112/475.02 |
| 5,588,384 | A * | 12/1996 | Miyachi et al. | ..... | 112/475.06 |
| 5,906,698 | A * | 5/1999 | House et al. | ..... | 156/137 |
| 6,397,768 | B1 * | 6/2002 | Dasher et al. | ..... | 112/2.1 |

* cited by examiner

*Primary Examiner* — Ismael Izaguirre
(74) *Attorney, Agent, or Firm* — Notaro, Michalos & Zaccaria P.C.

(57) ABSTRACT

Positioning device adapted to dispose a strip of fabric or other similar material on an article of clothing do as to form a loop, the strips divided into a central portion and two opposite ends, the positioning device rotates at least one of the two ends of the strip in order to bring that end or ends into abutment with the central portion of the strip; and wherein guide means guide the end or ends of the strip during rotation.

10 Claims, 8 Drawing Sheets

POSITIONING DEVICE FOR THE POSITIONING OF LOOPS FOR SEWING SAID LOOPS AND SEWING MACHINE COMPRISING SAID DEVICE

FIELD AND BACKGROUND

The present invention refers, in general, to a positioning device for the positioning of loops and to a sewing machine comprising said device. More particularly, the present invention relates to a positioning device and to a sewing machine comprising said device, to appropriately arrange and position a loop on a garment during processing, for instance trousers.

As is known, several typologies of garments need loops, which are small fabric or leather strips through which bands, belts, strings or similar elements pass.

As represented in FIG. 1, a loop 10 is usually fixed on an article of clothing 12 by means of seams 14 of the ends 18, 20 of the strip 16 that forms the loop. In particular, in order to make the fixing more stable, the ends 18, 20 are turned towards the article of clothing 12 so that the seam 14 is stitched on the portions 22, 24 of the strip 16, these portions being superimposed on the ends 18, 20 bent. In this way, it is possible to double the portion of strip sewn on the article of clothing and the seam is made more solid.

In order to stitch said seam, the sewing machines of the prior art comprise suitable devices which allow to bend the ends 18, 20 of the strip 16 inwards and to position the strip on the fabric area on which the loop has to be formed.

In particular, once the positioning devices according to the prior art have grabbed the strip 16 acting as a loop, the positioning devices rotate both ends 18, 20 180 degrees so that both ends are arranged under the remaining part of the strip 16.

The positioning devices according to the prior art do not ensure a perfect positioning of the strip ends 18, 20 to bend so that an unwished effect is obtained as represented in FIG. 2 from which it appears how the ends 18, 20 are not perfectly hidden under the remaining part of the strip 16.

SUMMARY OF THE INVENTION

An aim of the invention is to remove the above-mentioned drawbacks and others, through the realization of a positioning device for the positioning of loops allowing a precise positioning and a perfect alignment of the strip forming the loop on the article of clothing.

In particular, an aim of the invention is to provide a positioning device allowing a precise positioning of each portion of the strip, and precisely a perfect overlap of the ends 18, 20 with the portions 22, 24 of the strip 16, as represented in FIG. 3.

Another aim of the invention is to carry out a loop positioning device that must be not only precise but also rapid and reliable at the same time.

Another aim of the invention is to carry out a positioning device that must be simple as regards the construction.

The above-mentioned aims and others are achieved according to the invention through a positioning device adapted to dispose a strip of fabric or other similar material on an article of clothing on which said strip has to be sewn so as to form a loop, said strip being divided in a central portion and two opposite ends. The positioning device comprises rotation means to rotate at least one of the two ends of the strip in order to bring this end in abutment with the central portion of the strip.

The positioning device according to the invention is characterized by the fact of comprising guide means to guide the at least one of said two ends of the strip in the rotation of the same end so that this end is superimposed completely to the central portion of the strip without showing any hems out of the area covered by the central portion.

Advantageously, the guide means of the positioning device according to the invention may comprise at least two plates positioned substantially perpendicular to the strip and adapted to be put in contact with the respective opposite side edges of the strip. The two plates allow that the end of the strip is received, in its rotation, between the two plates so as to be guided by said two plates up to go in contact with the central portion of the strip on completely overlapping the same central portion.

Besides, the guide means may comprise lifting means to lift the two or more plates so as to allow the positioning of the strip on the article of clothing on which the strip has to be sewn, after the strip has been appropriately bent at its ends.

Advantageously, the guide means may comprise first adjusting means to adjust the distance between said two plates acting on the same end of the strip so as to adapt the guide means to the width of the strip.

The guide means may comprise at least one support on which the two or more plates are connected by means of a pin and elastic means so that the two plates may rotate in relation to the support on maintaining the contact with the opposite side edges of the strip and are forced to return to their initial rest position by the elastic means.

Besides, the rotation means may comprise at least one fork which rotates on itself so as to cause the rotation of one or both of the two ends; since the fork goes in contact, in its rotation, with at least one of the two plates and the two plates are pivoted on the support, the two plates follow the movement of the fork and rotate.

The positioning device according to the invention may comprise two first plates and two second plates; the first two plates are adapted to guide a first end of the strip in its rotational motion so as to be completely superimposed to the central portion of the strip; the two second plates are adapted to guide a second end of the strip in its rotational motion so as to be completely superimposed to the central portion of the strip.

Advantageously, in the positioning device according to the invention, second adjusting means may be comprised to adjust the distance between the two first plates and the two second plates so as to adapt the guide means to the length of the strip.

In addition, chamfers are obtained in the plates and act as invitation in the receiving phase of an end between two plates.

In the positioning device according to the invention, hook means may be comprised to lift a part of the central portion of the strip in order to create a sufficient space for the passage of a belt or strap or other equivalent element between the article of clothing and the strip, once said strip has been sewn. It is to be intended that the aims and advantages of the invention are also achieved by a sewing machine comprising a positioning device for the positioning of loops.

DESCRIPTION OF THE DRAWINGS

Further features and details of the invention can be better understood from the following description which is provided as a non-limiting example as well as from the accompanying drawings wherein.

DESCRIPTION OF THE PREFERRED EMBODIMENTS

Figure 1:
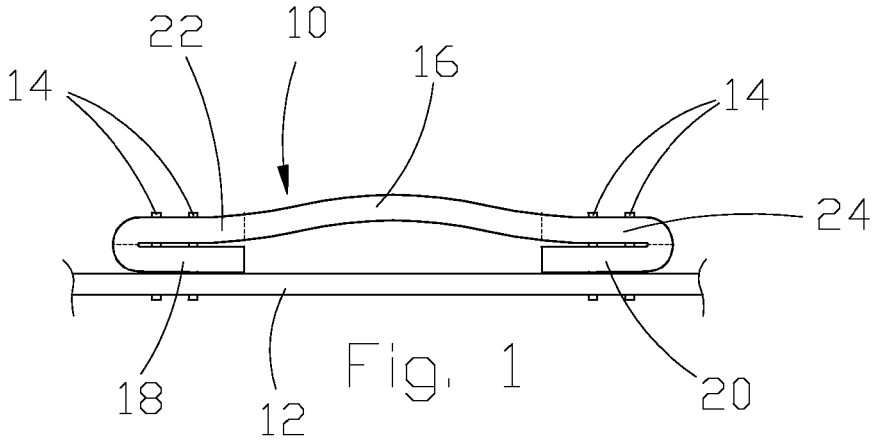
Fig. 1 PRIOR ART
FIGS. 1, 2 are side and top views, respectively of a loop, sewn on an article of clothing according to the prior art.
Figure 2:
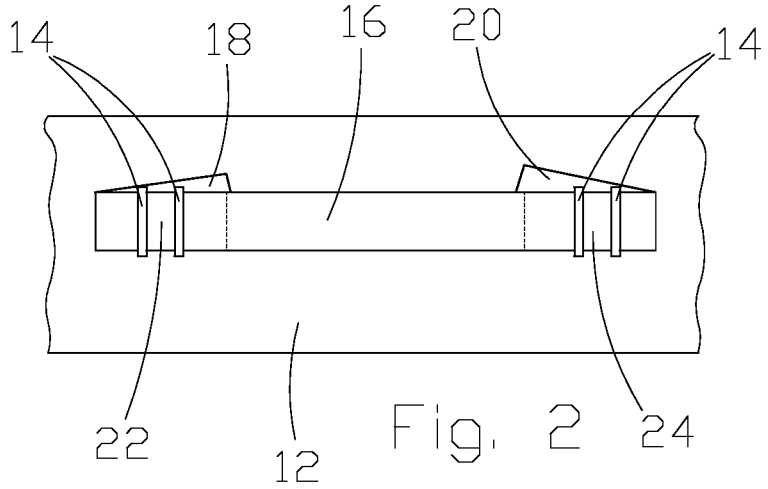
Fig. 2 PRIOR ART
Figure 3:
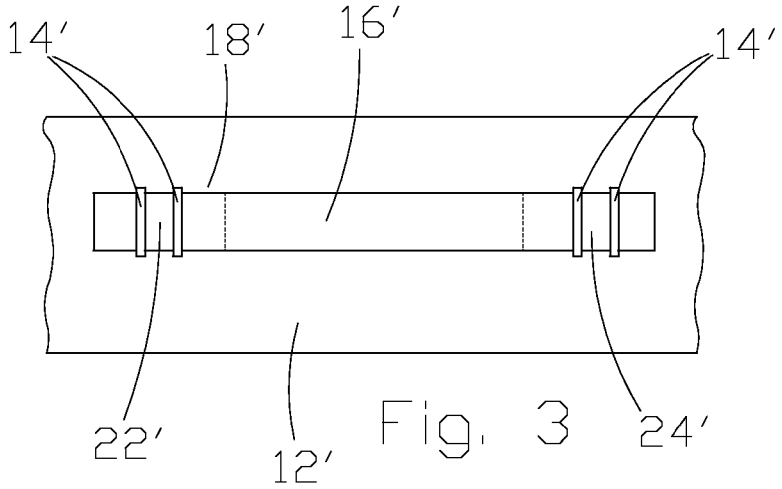
FIG. 3 is a top view of a loop positioned and sewn on an article of clothing in the optimal position.

The positioning device comprises:

- a slide and support device 26 for the strip 16, this device being adapted to bring and support the strip 16 in a processing position in which the strip is prearranged to be sewn;
- a first fork 28 and a second fork 30, each of them being able to cause the rotation of the first end 18 and the second end 20 of the strip 16, respectively;
- a hook device 32 for the lifting of a portion of the strip 16 so as to form a sufficient space between the loop and the article of clothing for the passage of a belt or other similar element;
- a straightening device 34 allowing a correct positioning of the first end 18 and second end 20 when these ends are rotated.

The slide and support device 26 comprises movement and traction means (not represented in the figures) and more specifically pliers to displace the strip 16 from a loading position to a machining position in which the strip 16 is subjected to the necessary operations in order to be appropriately conformed, as described below, before being sewn on the article of clothing.

The slide and support device 26 comprises supporting elements 36 that support the strip 16 in the machining position.

Figure 8:
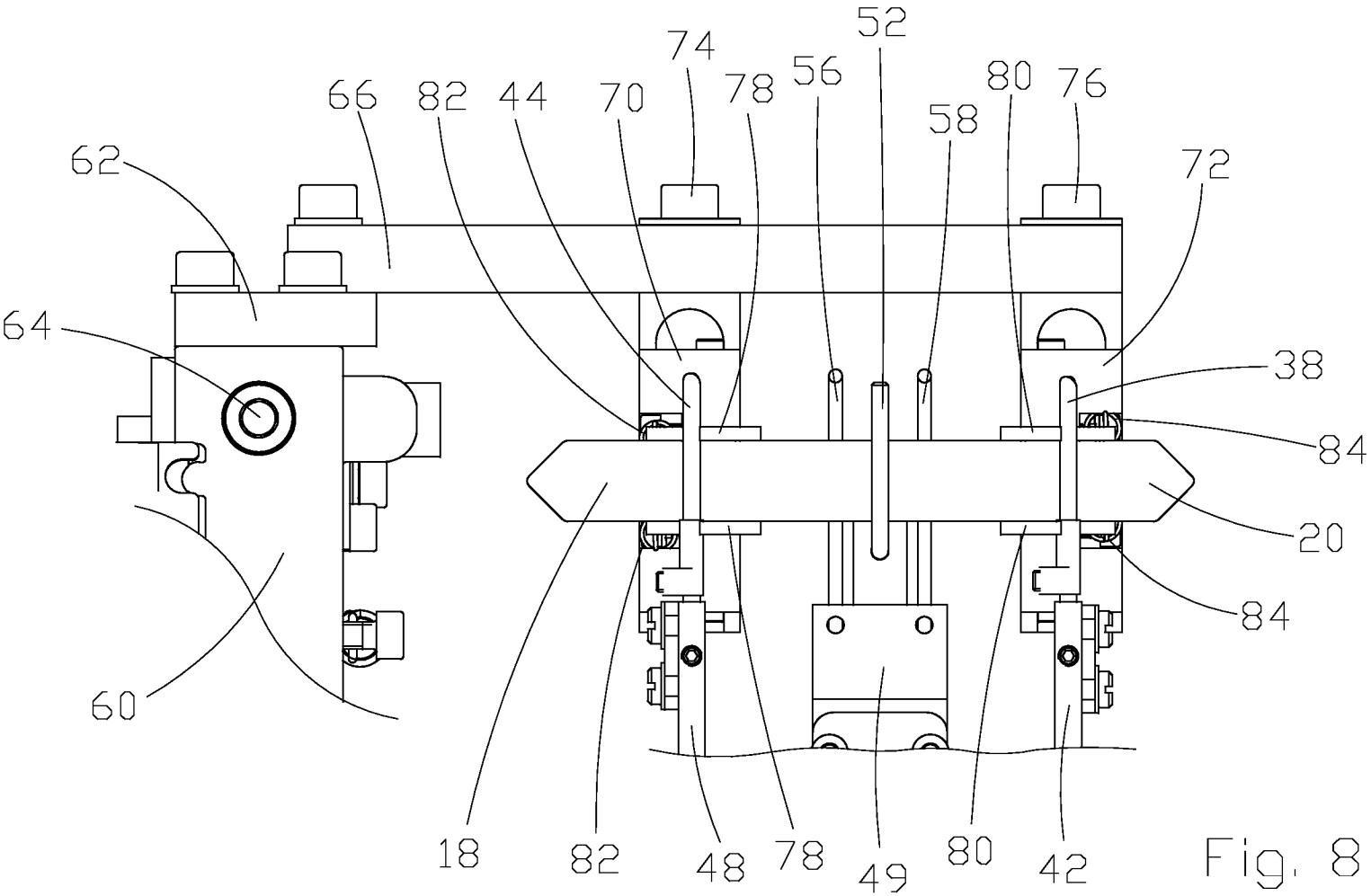
FIGS. 8, 9, 11, 13 are side views of the device in FIG. 4 during the following working phases.

The first fork 28 comprises a first tooth 38 and a second tooth 40 which are put side by side and are connected to a first shaft 42, visible in FIG. 8, which may rotate around its own axis. The first tooth 38 is coaxial to the first shaft 42 so that when the first shaft 42 rotates, also the first tooth 38 rotates around itself while the second tooth 40 rotates around the first tooth 38.

Similarly, the second fork 30 comprises a first tooth 44 and a second tooth 46 which are put side by side and are connected to a second shaft 48, visible in FIG. 8, which may rotate around its own axis. The first tooth 44 of the second fork 30 is coaxial to the second shaft 48 so that when the second shaft 48 rotates, also the first tooth 44 rotates around itself while the second tooth 46 rotates around the first tooth 44.

The hook device 32 comprises a support 49 on which an actuator, not visible in the figures, is fixed. An L-shaped element 50 is adjustably united to said actuator and comprises a lower portion 52 which is arranged under the strip 16 and acts as a hook for the lifting of a portion of the strip 16.

The fixing of the L-shaped element 50 to the actuator is obtained by means of a screw 54 that allows to vary the position of the L-shaped element 50 depending on the space to be obtained between the loop 10 and the article of clothing 12.

Besides, a first pin 56 and a second pin 58 are fixed to the support 49 and are arranged at a side of the L-shaped element and above the strip 16 when the strip 16 is in the machining position.

The first pin 56 and the second pin 58 are fixed in relation to the support 48 while the L-shaped element 50 is movable.

Figure 6:
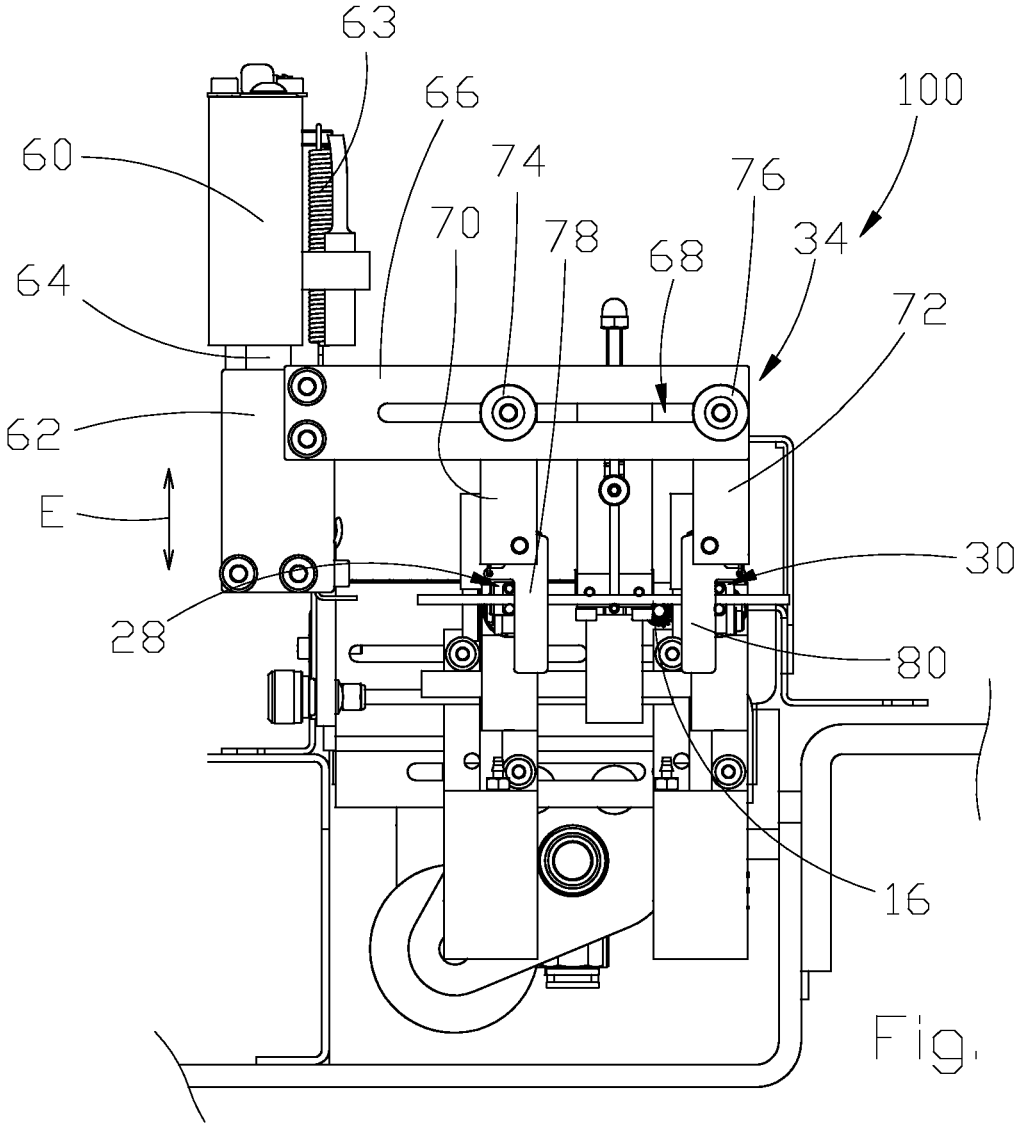
FIG. 6 is a side view of the device in FIG. 4 during a first working phase.

The straightening device 34 comprises a support 60 fixed to the frame of the sewing machine. A block 62 is connected to the support 60 by means of an actuator 64 which may move the block 62 vertically according to a direction E. A return spring 63, visible in FIG. 6, is united through an end to the support 60 and through the other end to the block 62 so that the block 62 is forced to rise when the actuator 64 is not actuated.

A rod 66 is fixed to the block 62 rigidly and has an oblong hole 68. A first support 70 and a second support 72 are fixed adjustably to the rod 66 by means of adjusting screws 74, 76 which pass through the oblong hole 68 and may adjust the position of the first support 70 and second support 72 horizontally.

Two first plates 78 are pivoted to the first support 70 and similarly, two second plates 80 are pivoted to the second support 72; the two first plates 78 as well as the two second plates 80 are separated from each other by a distance equal to the width of the strip 16. Only in FIG. 8 it is possible to see the two first plates 78 and the two second plates 80.

In addition, each of the first plates 78 and each of the second plates 80 are connected with first springs 82 and second springs 84 to the first support 70 and to the second support 72, respectively. The first springs 82 and the second springs 84 allow to bring the first plates 78 and the second plates 80 again in the vertical position in case the plates are forced to tilt.

The operations performed by the positioning device 100 to suitably bend and position the strip 16 on the wished area of the article of clothing 12 on which said strip has to sewn to obtain a loop 10 are described below.

Figure 4:
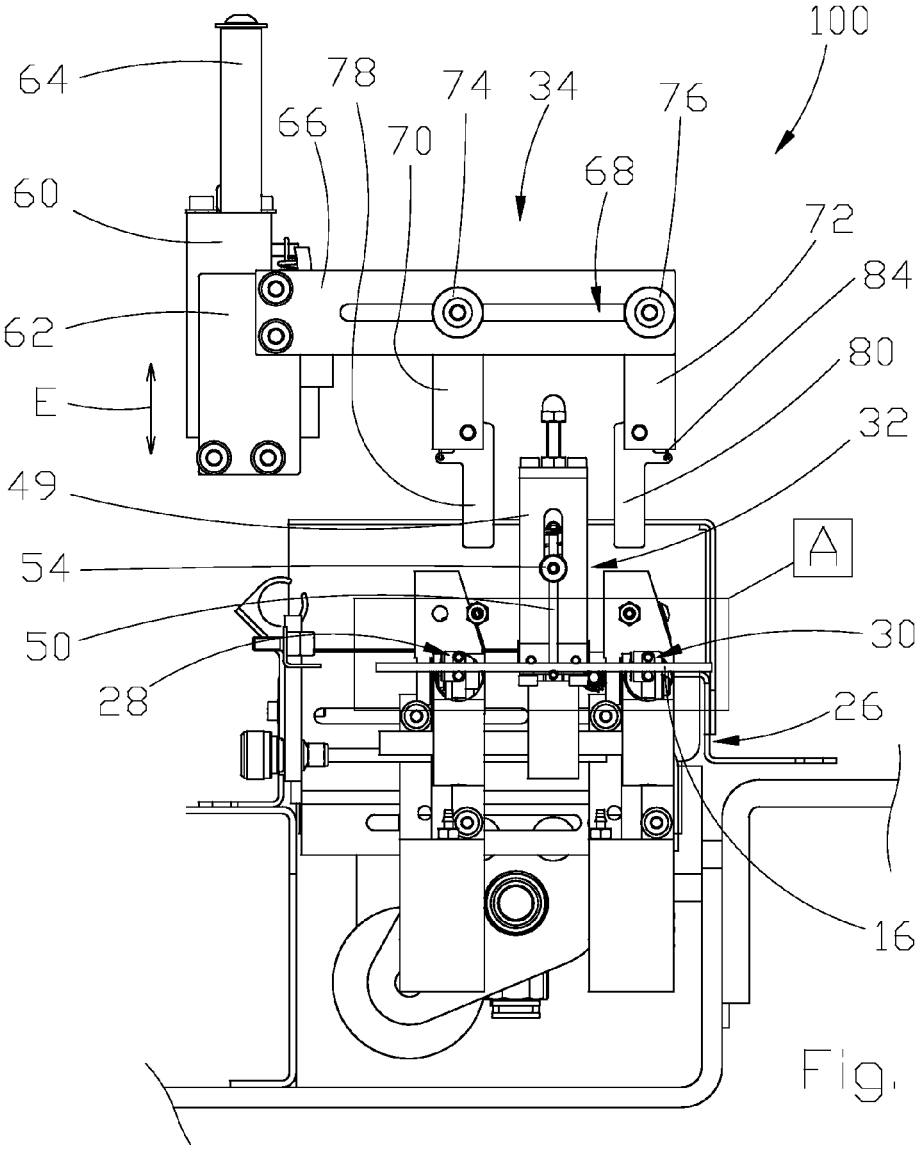
FIG. 4 is a side view of a positioning device according to the invention, in the initial phase of the process of positioning of a loop.
Figure 5:
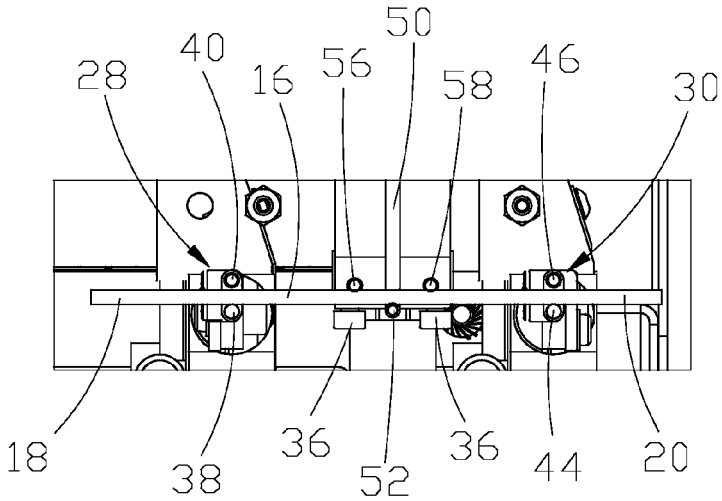
FIG. 5 is an enlarged view of a portion of device as shown in a cutout "A" in FIG. 4.
Figure 7:
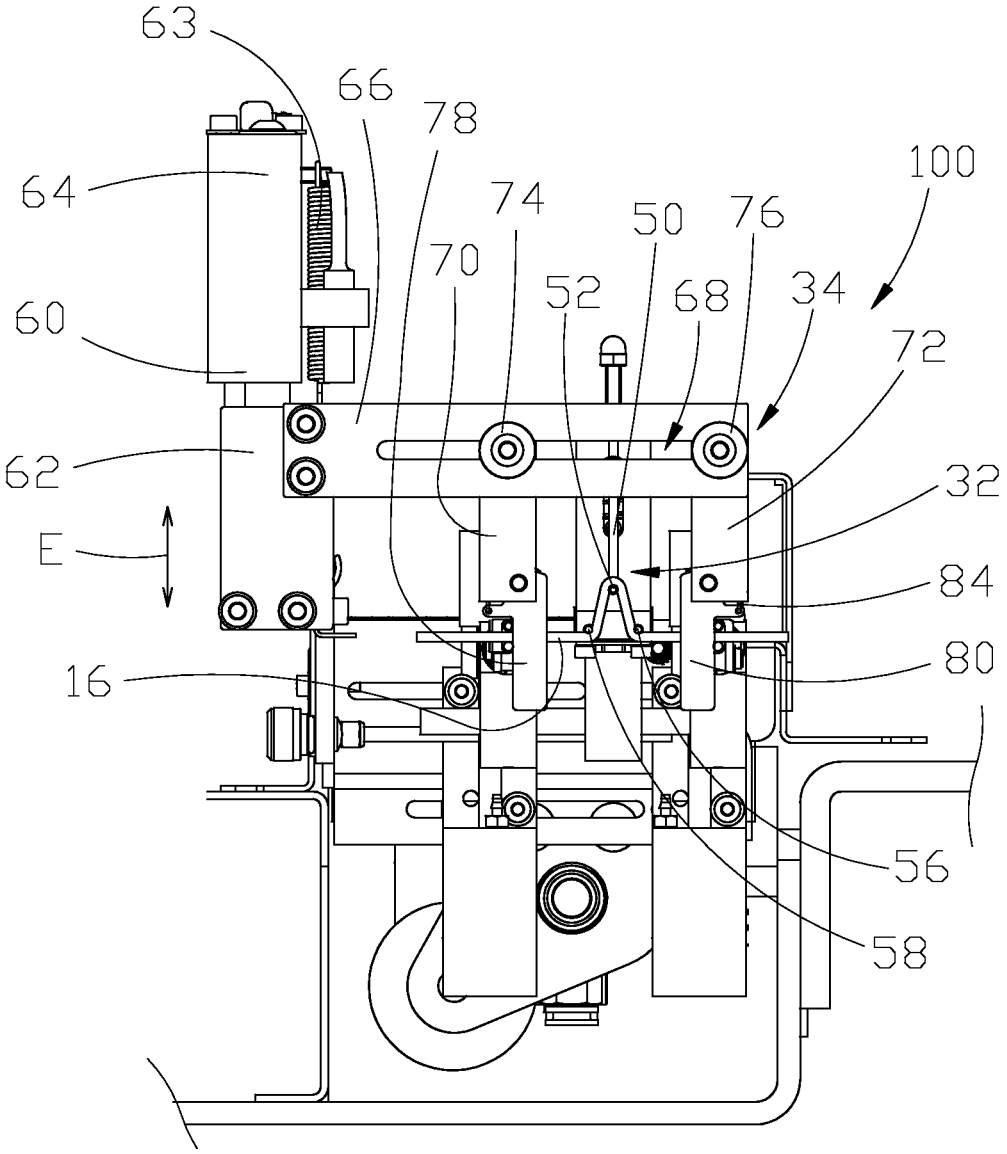
FIG. 7 is a bottom view of the positioning device according to the invention when it is arranged in the configuration represented in FIG. 6.

As it appears from FIGS. 4, 5, the strip 16 is unrolled from a roll and is brought and supported in the machining position by the slide and support device 26. In particular, the strip 16 is pulled by the movement and traction means, specifically by the pliers, and supported by the supporting elements 36. As represented in FIGS. 6, 7, once the strip 16 is disposed in the machining position, the first plates 78 and the second plates 80 are lowered so that the strip 16 is received between plates 78, 80.

In particular, the actuator 64 is actuated so as to lower the block 62 and consequently the bar 66, the first support 70 and the second support 72 and therefore, also the first plates 78 and the second plates 80. The first fork 28 and the second fork 30 are advanced so that on a side, the strip 16 is disposed between the first tooth 38 and the second tooth 40 of the first fork 28 and on the opposite side, the strip 16 is disposed between the first tooth 44 and the second tooth 46 of the second fork 30 while centrally, the strip 16 is kept in position on the upper part by the first pin 56 and second pin 58 and on the lower part by the lower portion 52 of the L-shaped element of the hook device 32, in addition to the support elements 36.

The first tooth 38 and the second tooth 40 of the first fork 28 separate ideally the left end 18 (according to the accompanying drawings) from the central portion of the strip 16 and similarly, the first tooth 44 and the second tooth 46 of the second fork 30 separate ideally the right end 20 (according to the accompanying drawings) from the central portion of the strip 16.

The strip 16, arranged in its machining position as indicated above, is cut at the opposite end to the pliers according to the wished length.

Then, as it appears from FIG. 8, the hook device 32 is actuated to lift a portion of the strip 16 in order to obtain a sufficient space between the loop 10 and the article of clothing 12 for the passage of a belt or strap.

In particular, the actuator included in the support 49 is actuated to move up the L-shaped element 50 and its lower portion 52 that lifts the central portion of the strip 16.

Figure 9:
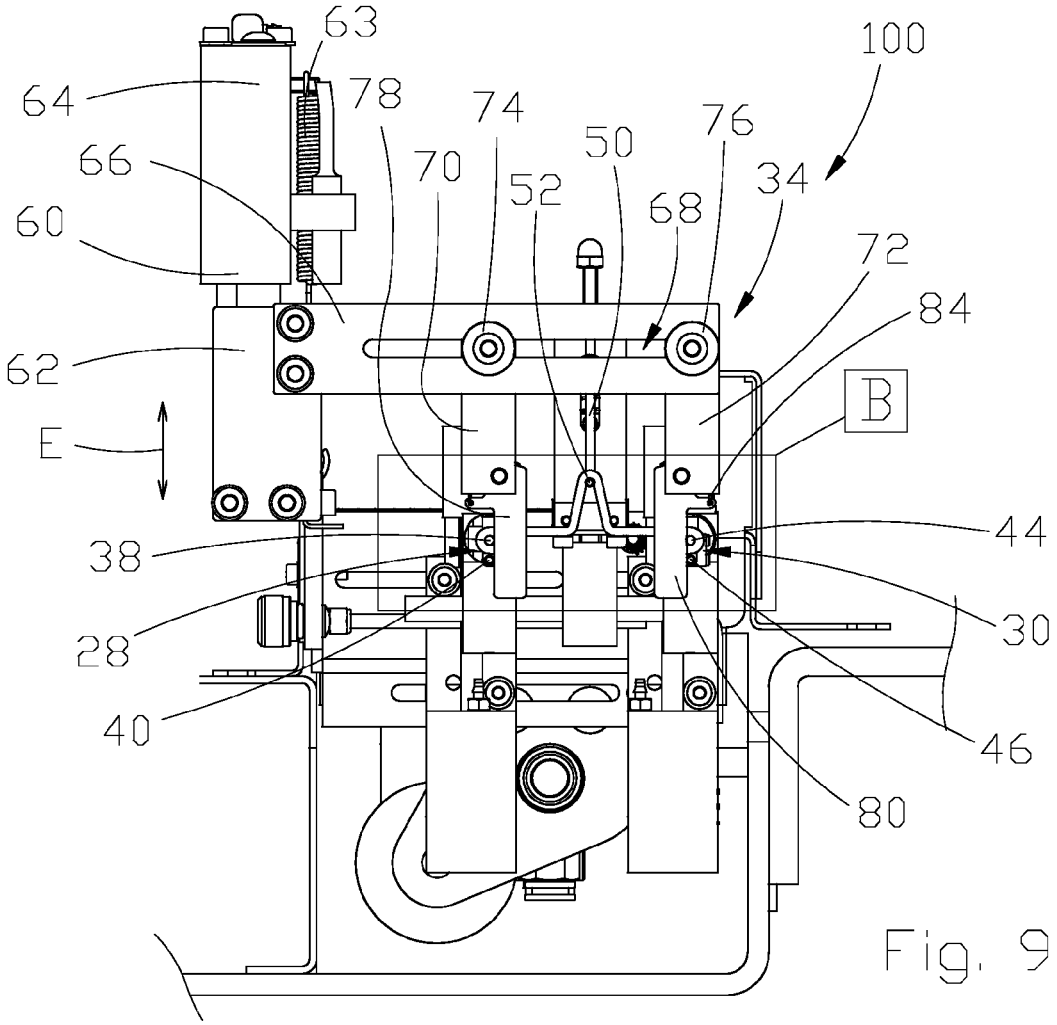
Figure 10:
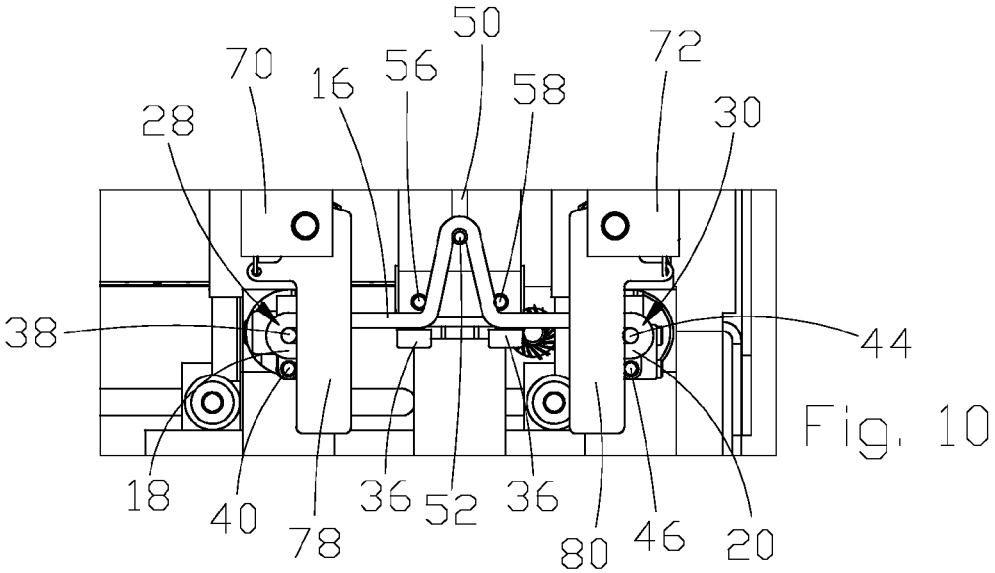
FIG. 10 is an enlarged view of the portion of device as shown in a cutout "B" in FIG. 9.

Then, as represented in FIGS. 9, 10, the first fork 28 is rotated 180 degrees anticlockwise (considering the point of observation of FIG. 10) so that the first tooth 38 rotates around itself and the second tooth 40 rotates around the first tooth 38. In this way, the left end 18 is brought below the remaining portion of the strip 16.

Figure 13:
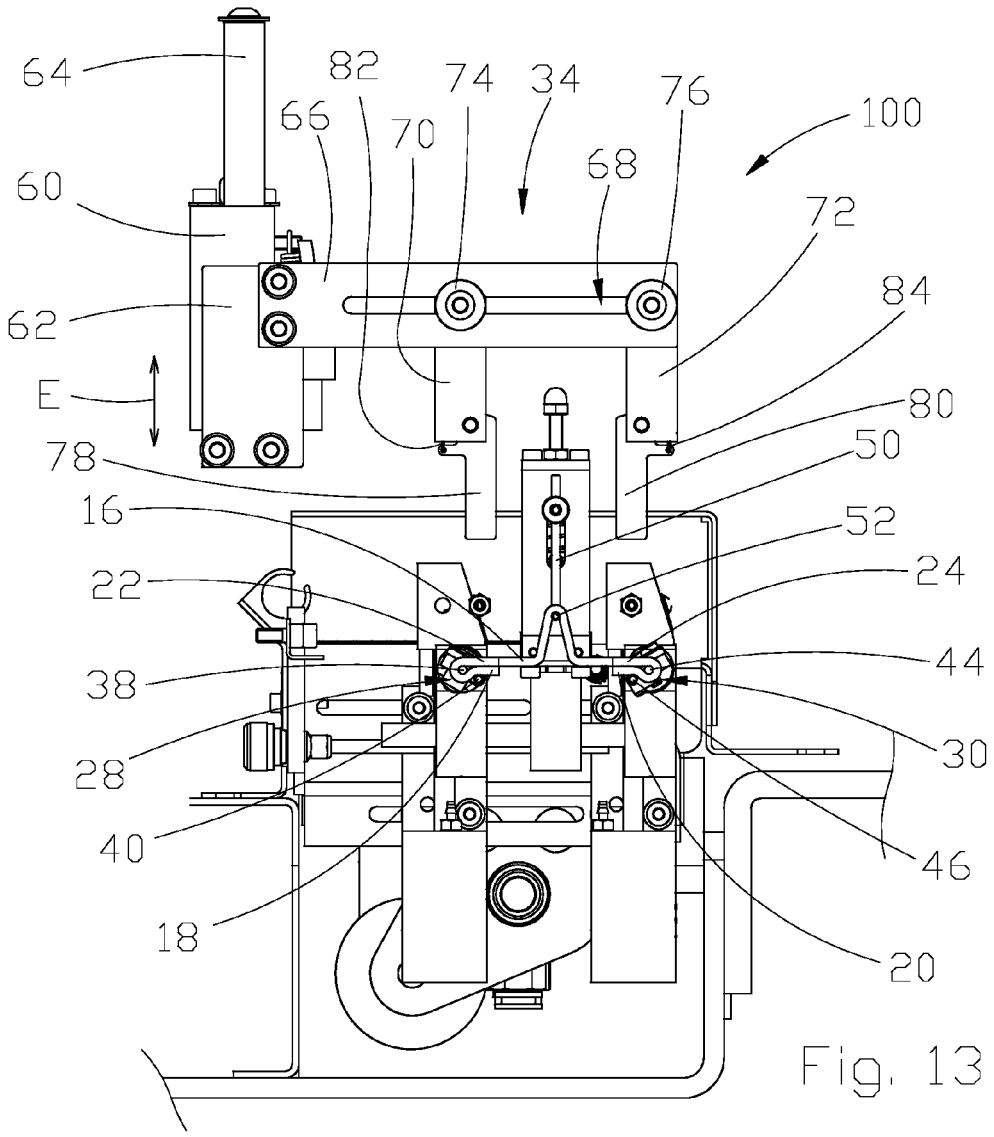

The first plates 78 guide the movement of the left end 18 on avoiding that the left end 18 protrudes laterally in respect to the remaining portion of the strip 16 and indeed, causing the left end 18 to be exactly positioned under the strip 16 and more precisely, under the overlying lateral left portion, ideally identified in FIGS. 1, 13 and denoted here by reference number 22.

Likewise, the second fork 30 is rotated 180 degrees clockwise (considering the point of observation of FIG. 10) so that the first tooth 44 rotates on itself and the second tooth 46 rotates around the first tooth 44. In this way, the right end 20 is brought below the remaining portion of the strip 16.

Like the first plates 78, the second plates 80 guide the movement of the right end 20 on avoiding that the right end 20 protrudes laterally in respect to the remaining portion of the strip 16 and indeed, causing the right end 20 to be exactly positioned under the strip 16 and more precisely, under the overlying lateral right portion, ideally identified in FIGS. 1, 13 and denoted here by reference number 24.

Figure 11:
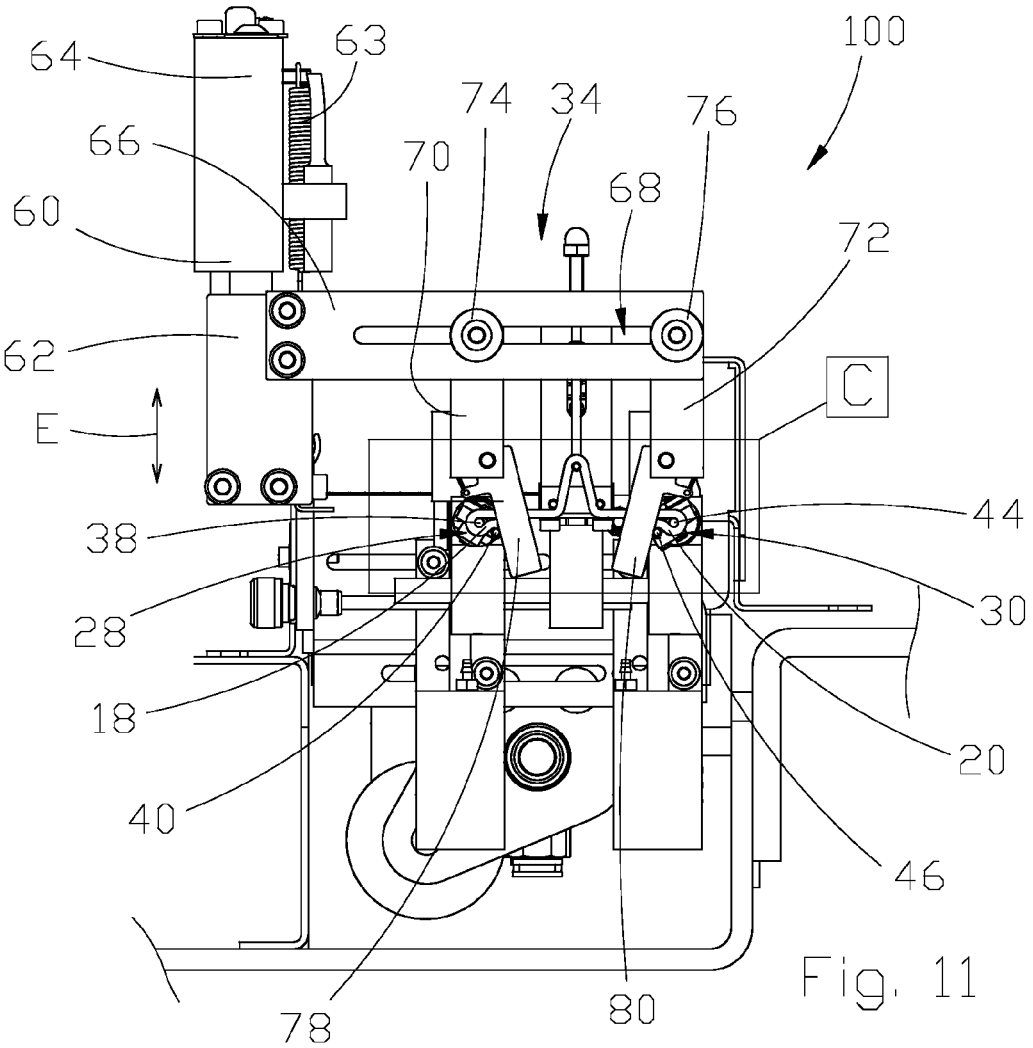
Figure 12:
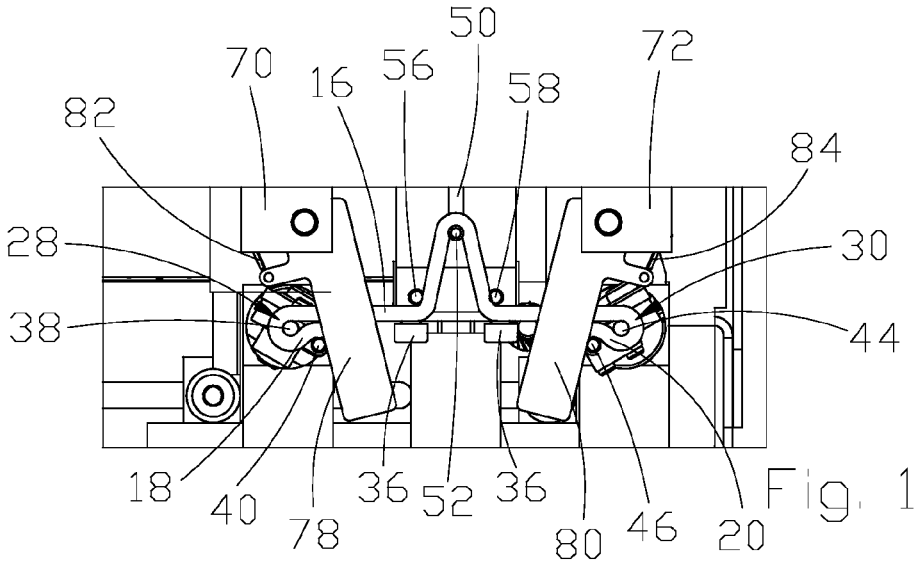
FIG. 12 is an enlarged view of the portion of device shown in a cutout "C" in FIG. 11.

As represented in FIGS. 11, 12, in order to facilitate the sewing of the strip 16 on the article of clothing 12, the left end 18 and the right end 20 are brought in contact with the strip 16.

In particular, the first fork 28 is rotated 40 degrees so that the second tooth 40 forces the left end 18 to contact and press the overlying lateral left side 22. The second tooth 40 of the first fork 28 contacts and pushes the first plates 78 which are forced to tilt, even if pulled in the opposite direction by the springs 82, but which keep the left end 18 in the correct position.

Likewise, also the second fork 30 is rotated an additional 40 degrees so that the second tooth 46 forces the right end 20 to contact and press the overlying lateral right side 24. The second tooth 46 of the second fork 30 contacts and pushes the second plates 80 which are also forced to tilt, even if pulled in the opposite direction by the springs 84, but which keep the right end 20 in the correct position.

Then, as represented in FIG. 13, the actuator 64 of the straightening device 34 is deactivated and the return spring 63 provokes the lifting of the block 62, the bar 66, the first support 70 and the second support 72. Consequently, also the first plates 78 and the second plates 80 are lifted and positioned vertically through the action of the respective springs 82, 84.

Thus, the strip 16 is so shaped that the strip 16 may be sewn at the lapels made by the positioning device 100, namely at the overlying lateral left portion 22 and the overlying lateral right portion 24 and consequently, at the left end 18 and the right end 20.

Finally, the positioning device 100 translates the so-shaped strip 16 by means of the first fork 28 and second fork 30 above the article of clothing 12 in the position in which the strip 16 has to be sewn to form a loop 10.

The positioning device 100 according to the invention allows to arrange a strip in the suitable configuration for the realization of a loop; in particular, the positioning device 100 allows to bend the strip ends and place them exactly under the portions of the strip on avoiding unwished projections that would cause undesirable aesthetic effects.

The positioning device 100 according to the invention has a considerable flexibility of use and may be used regardless of the size of the loop to obtain; indeed, the presence of oblong holes and adjusting screws allows to horizontally vary the position of the first plates 78 and second plates 80 as well as the position of the first fork 78 and second fork 30 in order to adjust the processing when the length of the strip varies.

Figure 14:
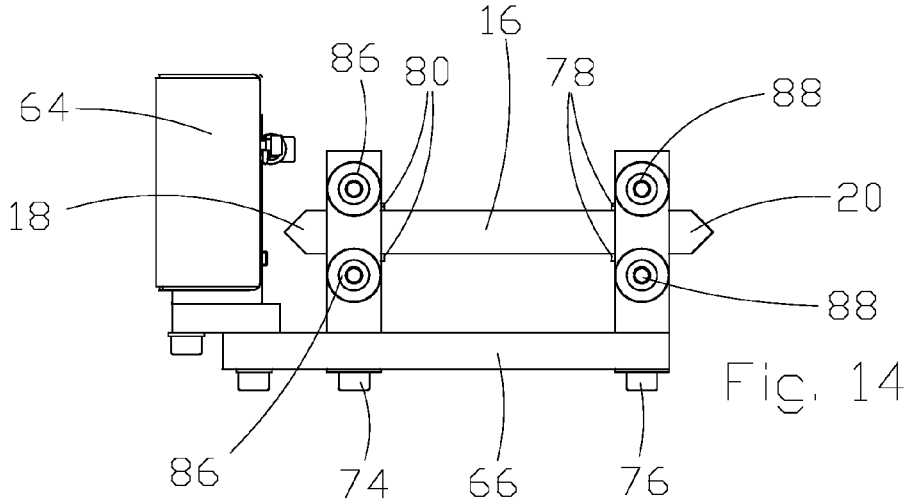
FIG. 14 is a top view of the positioning device according to the invention. With reference to the accompanying figures, in particular FIG. 4 and following figures, number 100 denotes a positioning device that can be mounted on a frame of a sewing machine. The positioning device 100 is used to suitably bend and position a strip 16 in a wished area of an article of clothing on which the strip has to be sewn in order to obtain a loop 10.

Besides, also the distance between the two first plates 78 as well as between the second plates 80 may be varied so that it is possible to use the positioning device 100 also when the length of the strip 16 to be shaped varies. Indeed, as it appears from FIG. 14, the first support 70 and the second support 72 are provided with two first adjusting screws 86 and two second adjusting screws 88, respectively. Each of the screws fixes the first plates 78 and the second plates 80 releasably. For instance, by unscrewing one of the two first adjusting screws 86 it is possible to laterally displace one of the two first plates 78 and to vary its position according to the width of the strip 16.

The first plates 78 as well as the second plates 80 are shaped in such a way as to facilitate the insertion of the strip 16 between the plates when the plates are lowered. The shape is represented by a chamfer suitably made to facilitate a correct insertion of the strip 16 between the plates.

A technician of the sector may provide amendments or variants that are to consider as included in the scope of protection of the present invention.

The invention claimed is:

1. Positioning device adapted to dispose a strip on an article of clothing on which said strip has to be sewn so as to form a loop, said strip being divided in a central portion and two opposite ends, said positioning device comprising rotation means to rotate at least one of said two ends of the strip in order to bring the at least one of said two ends in abutment with the central portion of the strip;

characterized by the fact of comprising guide means to guide the at least one of said two ends of the strip during the rotation of the least one of said ends so that the at least one of said two ends is superimposed completely to the central portion of the strip, and wherein the guide means comprise at least two plates positioned substantially perpendicular to the strip and adapted to be arranged laterally in contact with the respective opposite side edges of the strip so that the at least one of said two ends is received, in its rotation, between said at least two plates so as to be guided by said two plates laterally and along the tape feed direction to go in contact with the central portion of the strip on overlapping completely to the same central portion of the strip.

2. Positioning device according to claim 1, wherein the guide means comprise lifting means to lift said at least two plates.

3. Positioning device according to claim 2, wherein hook means are comprised to lift a part of the central portion of the strip in order to create a sufficient space for the passage of a belt or strap or other equivalent element between the article of clothing and the strip, once said strip has been sewn.

4. Positioning device according to claim 1, wherein the guide means comprise first adjusting means to adjust the distance between said at least two plates so as to adapt the guide means to the width of the strip.

5. Positioning device according to claim 1, wherein chamfers are provided in the at least two plates for guiding the at least one of said two ends during rotation.

6. A sewing machine comprising a machine body, a sewing section and a positioning device according to claim 1.

7. Positioning device adapted to dispose a strip on an article of clothing on which said strip has to be sewn so as to form a loop, said strip being divided in a central portion and two opposite ends, said positioning device comprising rotation means to rotate at least one of said two ends of the strip in order to bring the at least one of said two ends in abutment with the central portion of the strip; characterized by the fact of comprising guide means to guide the at least one of said two ends of the strip during the rotation of the least one of said ends so that the at least one of said two ends is superimposed completely to the central portion of the strip; wherein the guide means comprise at least two plates positioned substantially perpendicular to the strip and adapted to be arranged laterally in contact with the respective opposite side edges of the strip so that the at least one of said two ends is received, in its rotation, between said at least two plates so as to be guided by said two plates up to go in contact with the central portion of the strip on overlapping completely to the same central portion of the strip, and, wherein the guide means comprise at least one support to which said at least two plates are connected by means of a pin and elastic means so that said at least two plates may rotate in relation to the at least one support on maintaining the contact with the opposite side edges of the strip, and are forced to return to their initial rest position by the elastic means.

8. Positioning device according to claim 7, wherein the rotation means comprise at least one fork which rotates on itself so as to cause the rotation of the at least one of said two ends, said at least one fork going in contact, in its rotation, with at least two plates which are adapted to the movement of the at least one fork and rotate, since said at least two plates are pivoted to the at least one support.

9. Positioning device adapted to dispose a strip on an article of clothing on which said strip has to be sewn so as to form a loop, said strip being divided in a central portion and two opposite ends, said positioning device comprising rotation means to rotate at least one of said two ends of the strip in order to bring the at least one of said two ends in abutment with the central portion of the strip;

characterized by the fact of comprising guide means to guide the at least one of said two ends of the strip during the rotation of the least one of said ends so that the at least one of said two ends is superimposed completely to the central portion of the strip;

wherein the guide means comprise at least two plates positioned substantially perpendicular to the strip and adapted to be arranged laterally in contact with the respective opposite side edges of the strip so that the at least one of said two ends is received, in its rotation, between said at least two plates so as to be guided by said two plates up to go in contact with the central portion of the strip on overlapping completely to the same central portion of the strip, and wherein two first plates, adapted to guide a first end of said two ends of the strip in its rotational motion so as to be completely superimposed to the central portion of the strip;

two second plates, adapted to guide a second end of said two ends of the strip in its rotational motion so as to be completely superimposed to the central portion of the strip.

10. Positioning device according to claim 9, wherein second adjusting means are comprised to adjust the distance between said at least two first plates and said second plates so as to adapt the guide means to the length of the strip.

* * * * *